United States Patent [19]

Waeber et al.

[11] Patent Number: 5,008,978

[45] Date of Patent: Apr. 23, 1991

[54] APPARATUS FOR TREATING COTTON CONTAMINATED WITH HONEYDEW

[75] Inventors: René Waeber; Fritz Knabenhans; Othmar Bachmann, all of Winterthur, Switzerland

[73] Assignee: Maschinenfabrik Rieter AG, Winterthur, Switzerland

[21] Appl. No.: 503,524

[22] Filed: Apr. 2, 1990

Related U.S. Application Data

[62] Division of Ser. No. 359,495, May 31, 1989.

[30] Foreign Application Priority Data

Jun. 3, 1988 [CH] Switzerland ..... 2121/88

[51] Int. Cl.[5] ..... D01G 9/00; D01G 37/00

[52] U.S. Cl. ..... 19/66 CC; 19/0.27

[58] Field of Search ..... 19/66 CC, 200, 0.27, 19/66 R; 219/10.55 A

[56] References Cited

U.S. PATENT DOCUMENTS

| | | | |
|---|---|---|---|
| 4,626,640 | 12/1986 | van der Heijdan | 219/10.55 A |
| 4,631,380 | 12/1986 | Tran | 219/10.55 A |
| 4,788,853 | 12/1988 | Bell | 73/73 |

FOREIGN PATENT DOCUMENTS

| | | | |
|---|---|---|---|
| 752535 | 12/1970 | Belgium | 19/0.27 |
| 196449 | 10/1986 | European Pat. Off. . | |
| 303575 | 2/1989 | European Pat. Off. | 19/0.27 |
| 3430673 | 2/1986 | Fed. Rep. of Germany . | |
| 3538899 | 5/1987 | Fed. Rep. of Germany . | |
| 557435 | 6/1974 | Switzerland . | |
| 771425 | 10/1980 | U.S.S.R. | 19/0.27 |
| 2030440 | 4/1980 | United Kingdom . | |

*Primary Examiner*—Werner H. Schroeder
*Assistant Examiner*—Michael A. Neas
*Attorney, Agent, or Firm*—Sandler, Greenblum & Bernstein

[57] ABSTRACT

The invention relates to an apparatus for treating cotton contaminated or imbued with honeydew. For this purpose, cotton flocks are fed into a microwave oven, in which the cotton flocks are heated by microwave energy, thus reducing the stickiness or tackiness of the honeydew such that there are no processing disadvantages on subsequent machinery. The microwave oven basically comprises a conveyor belt on which the cotton flocks are conveyed through a passage or channel provided with microwave generators. At the exit or outlet of the microwave oven the cotton flocks are transferred to an opening unit which transfers the cotton flocks into a feed chute or shaft.

18 Claims, 3 Drawing Sheets

APPARATUS FOR TREATING COTTON CONTAMINATED WITH HONEYDEW

CROSS-REFERENCE TO RELATED APPLICATIONS AND PATENTS

This application is a divisional of the commonly assigned, copending U.S. application Ser. No. 07/359,495, filed: May 31, 1989, entitled "METHOD OF AND APPARATUS FOR TREATING COTTON CONTAMINATED WITH HONEYDEW".

This application is related to the copending U.S. application Ser. No. 07/132,790, filed Dec. 10, 1987, entitled "TREATMENT OF COTTON", now U.S. Pat. No. 4,888,856, granted Dec. 26, 1989, and which application is a divisional application U.S. application Ser. No. 06/833,987, filed Feb. 26, 1986, entitled "TREATMENT OF COTTON", now U.S. Pat. No. 4,796,334 granted Jan. 10, 1989, which is related also to the commonly assigned, copending U.S. application Ser. No. 07/207,252, filed Jun. 15, 1988, entitled "TREATMENT OF COTTON", and which application is a continuation application to the aforementioned parent application, namely U.S. application Ser. No. 06/833,987. This application is also related to the commonly assigned U.S. application Ser. No. 07/359,494, filed May 31, 1989, and entitled "METHOD OF AND APPARATUS FOR REDUCING THE STICKINESS OF COTTON FLOCKS" and to the commonly assigned U.S. application Ser. No. 07/363,784, filed Jun. 9, 1989 and entitled "METHOD OF AND APPARATUS FOR REDUCING THE STICKINESS OF COTTON FLOCKS".

BACKGROUND OF THE INVENTION

The present invention relates to a new and improved apparatus for reducing the stickiness or tackiness of fibers of cotton flocks contaminated with honeydew.

It is known that cotton flocks of many provenances or origins are contaminated or coated to varying degrees with insect secretions which contain sugar. These sugar-containing secretions are generally termed honeydew. There is known a laboratory method by means of which such honeydew is allowed to caramelize by heating cotton flock samples in an oven for the purpose of determining the degree of honeydew contamination from the resulting change in the color of the cotton flocks. This is namely very important because, in the event of considerable contamination, the cotton flocks become sticky or tacky and tend to adhere to various parts of the yarn production plant or to form laps or coils at rolls or rollers or at other rotatable members. This result is very undesirable since it causes frequent interruptions of the yarn manufacturing process.

A method of the aforementioned type is disclosed in European Patent Application No. 86102352.1, published Oct. 8, 1986 under Publication No. 196,449. The object of this known method is to convert any contaminating honeydew into a non-sticky or non-adhesive and brittle state or condition by supplying heat for a short period of time, but without causing any discoloration or change in the color of the cotton flocks, so that the brittle sugar deposits can be crushed and removed in the course of subsequent processing.

A number of devices or apparatus for performing this prior art method have been proposed in the abovementioned European Patent Application No. 86102352.1, published under Publication No. 196,449. One device or apparatus is intended to heat the fiber flocks before the actual opening of the raw cotton bales, i.e. directly at the start of the yarn manufacturing process. Other devices or apparatus are intended for treating fiber slivers before drafting.

SUMMARY OF THE INVENTION

Therefore, with the foregoing in mind, it is a primary object of the present invention to provide a new and improved apparatus for treating cotton flocks contaminated with honeydew, by means of which the honeydew constituent of the contaminated cotton flocks is selectively heated with reduced energy consumption.

Another and more specific object of the present invention aims at providing a new and improved apparatus for treating cotton flocks, in which a uniform cotton flock batt or web is achievable and detrimental or undesired effects of uncontrolled heating are obviated.

To achieve the aforementioned objects, the inventive apparatus, in its more specific aspects, is manifested, among other things, by the features that the apparatus comprises a housing with a roof structured as an extraction or exhaust hood, a tunnel-type or tunnel-shaped microwave oven arranged in the housing and provided with an inlet and an outlet, a conveyor belt or band made of a material absorbing little microwave energy and provided for conveying the cotton flocks through the tunnel-type or tunnel-shaped microwave oven, and two deflection rolls or rollers each arranged at the inlet and the outlet of the tunnel-type or tunnel-shaped microwave oven, the conveyor belt being guided around these two deflection rolls or rollers, one of which is driveable.

The apparatus constructed according to the invention is based on the recognition that the water molecules contained in sugardew or honeydew are preferentially set into oscillation or vibration by microwave irradiation, thus effecting a more intensive heating of the honeydew constituent in comparison with the other constituents of the cotton flock web, so that the honeydew constituents are converted into the desired or required non-sticky or non-adhesive state. Such selective heating of the honeydew constituent substantially reduces the amount of heat energy required for the process as compared with other heating processes and obviates an excessive temperature of the cotton flocks themselves, so that the fire hazard or risk which must always be taken into account in the treatment of cotton flocks is substantially reduced. In this manner, the risk of an undesired or unwanted discoloration of the cotton flocks is precluded to a very large extent.

The energy supply to the cotton flocks may be effected during an intermittent or batch processing operation, i.e. the conveyor belt or band may stop in the microwave oven while the cotton flocks deposited thereupon are heated. However, the apparatus of the invention preferably carries out in a continuous or non-intermittent processing operation, i.e. heating is effected during the travel or movement of the conveyor belt or band through the tunnel of the microwave oven. One advantage of this is that the apparatus of the invention can be appropriately integrated into the yarn manufacturing process in which a continuous feed or supply of fiber flocks to the card or carding machine is desirable. Furthermore, the cotton flock web experiences, by virtue of the continuous movement, a uniform energy density and a correspondingly dosed amount of energy in the tunnel of the microwave oven, so that a particularly uniform heating of the honeydew constituents is accomplished. Therefore, there is avoided local heating of the cotton flock web to temperatures which would represent a fire hazard. In addition, there is no need for any form of wave agitator or stirrer since the energy density in the cotton flock web is rendered uniform by the continuous travel or movement.

Vapors escaping during the supply of heat in the microwave oven are preferably extracted during the heating process, so that the cotton flock web is already dry upon leaving the microwave oven.

A particularly preferred variant of the invention is characterized in that the fiber flocks remain in the tunnel-type or tunnel-shaped microwave oven for a time period in the range of 5 to 45 seconds, preferably from 20 to 40 seconds, and particularly during approximately 30 seconds, and that the energy supply is in the range of 50 to 300 kJ per kilogram of cotton, preferably at about 170 kJ per kilogram of cotton, for a flock web having a width in the range of 80 to 120 cm and a thickness in the range of 5 to 15 cm. The values indicated can be obtained with conventional apparatus or installations for processing cotton and with commercially available microwave generators as produced, for example, by the company Gigatherm in Heiden, Appenzell A.Rh., Switzerland.

More particularly, to achieve the maximum required energy density for a throughput of, for example, 300 kilograms cotton per hour, there are required about 5 to 15 microwave generators, preferably 12 microwave generators, each having an output power of 1.2 kilowatt, such microwave generators being preferably arranged in two rows.

A control of the energy density is effected not only by controlling the output energy of each microwave generator, but also can be varied within very broad limits by switching off one or several microwave generators. Furthermore, it is also possible to equip the installation with more microwave generators than would be necessary for the maximum degree of contamination, so that in the event of failure of one or the other microwave generator a new microwave generator can be placed into use. In this manner, the service life of the microwave oven can be substantially extended.

In the case of cotton flocks having only a low degree of honeydew contamination, the entire tunnel-type or tunnel-shaped microwave oven can be by-passed or put out of operation without this having any disadvantageous effects on the processing of the cotton flocks. It is, for instance, unnecessary to make any changes to the layout or design of the complete fiber processing installation or plant.

If, as indicated hereinbefore, the tunnel-type microwave oven consists of several microwave generators which can be operated at the same time or individually, then these preferably ten to fourteen microwave generators, in particular or advantageously twelve microwave generators, are preferably arranged in two rows and preferably above the conveyor belt or band. In this manner, using microwave generators having a commercially available width of about 40 cm, it is possible to arrange such microwave generators side by side in two rows with a lateral spacing, such that a flock web having a width of about 100 cm can be uniformly irradiated with microwaves i.e. microwave energy. The aforesaid width of 100 cm corresponds to the conventional width of the flock web at the outlet or exit of a blending opener or flock feeder, so that the microwave oven constructed according to the invention can be readily integrated into an existing installation or plant. The microwave oven constructed according to the invention or the inventive method or the inventive apparatus also can be applied or used in ginning.

For the protection of the operating personnel, preferably ferrite bar or rod arrangements or arrays are provided at the inlet and the outlet of the tunnel formed by the microwave oven. The openings at the inlet and the outlet of the microwave oven, the housing of which otherwise consists of full-length or solid sheet metal, are protected by these ferrite bars or rods from any possible escape of microwave radiation.

For the same purpose, there are provided screening plates which are arranged at the inlet and outlet sides upstream and downstream of the tunnel formed by the microwave generators and which extend preferably transversely with respect to the direction of travel of the cotton flock web and terminate directly in front of the surface of the cotton flock web.

When integrating the microwave oven constructed according to the invention in a cotton flock processing plant or unit, the cotton flock feed to the conveyor belt is effected through a flock chute or shaft which is arranged at the inlet or entry end of the microwave oven and has take-up or delivery rolls or rollers disposed at the bottom or lower end or end region of the flock chute or shaft. The cotton flock web delivered at the outlet or exit end of the tunnel-type microwave oven is preferably fed to an opening unit of a cleaning machine which feeds a flock feeder arranged upstream of one or several cards or carding machines.

As a variant, the cotton flock web can be cooled in a cooling zone, operated with cooling air, before the cotton flock web is fed to the opening unit of a cleaning machine. In this manner, the stickiness or tackiness of honeydew is still further reduced.

Finally, it should be mentioned that a particularly preferred embodiment of the apparatus constructed according to the invention is characterized in that alarm-type sensors or detectors are arranged within the housing of the tunnel-type microwave oven and are coupled by means of a control system with a halon gas fire-extinguishing installation. If a fire occurs in the microwave oven due to any unforeseen circumstances, the fire-extinguishing installation can extinguish this fire and simultaneously switch off the microwave generators. In this manner, effective fire control within the quasi-closed microwave oven is rendered possible.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
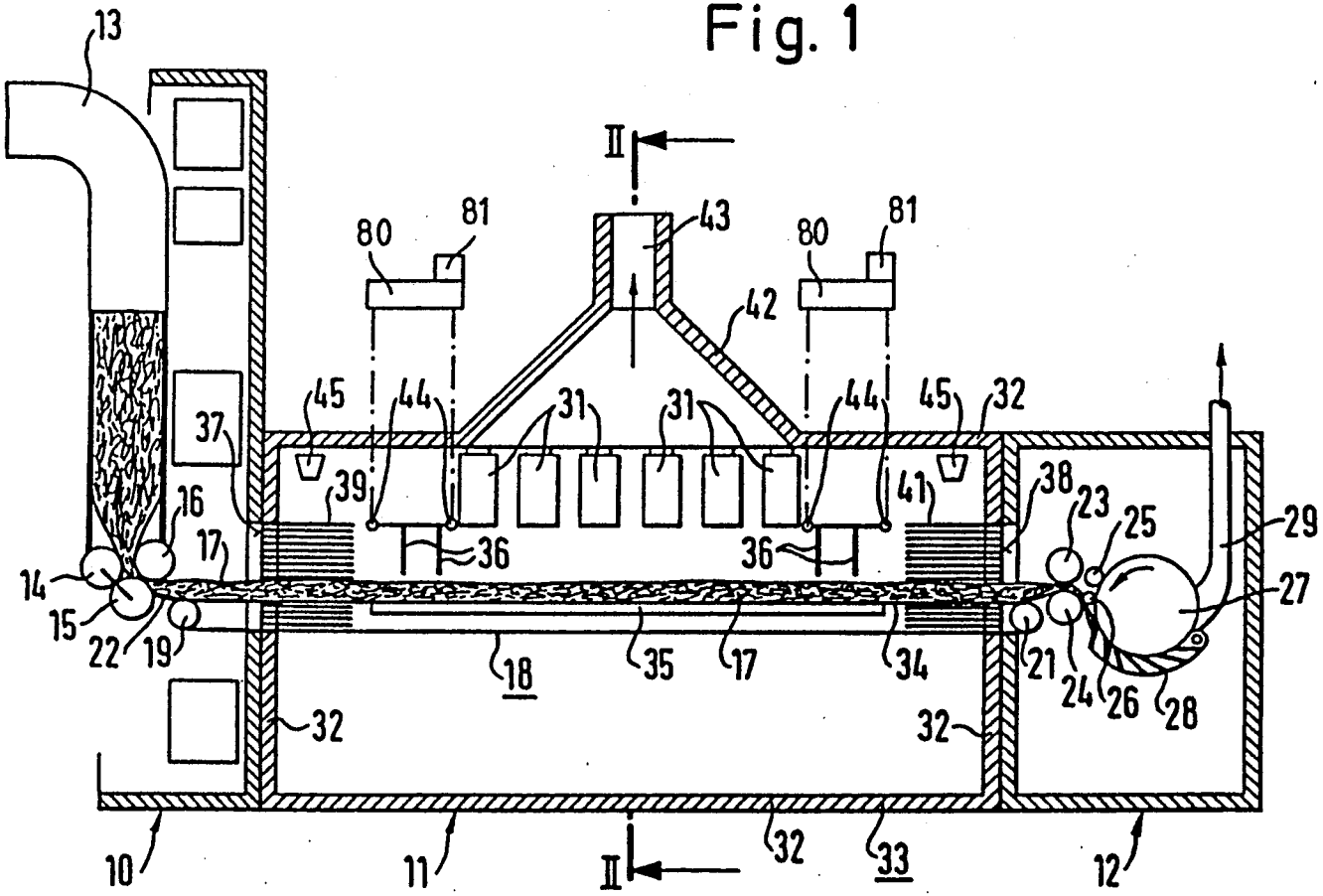
FIG. 1 shows a schematic side view of a part of a plant processing cotton flocks.

Describing now the drawings, it is to be understood that to simplify the showing thereof, only enough of the structure of the apparatus for realizing the inventive method of treating cotton flocks contaminated with honeydew has been illustrated therein as is needed to enable one skilled in the art to readily understand the underlying principles and concepts of this invention. Turning attention now specifically to FIG. 1 of the drawings, the apparatus illustrated therein by way of example and not limitation will be seen to comprise an outlet chute or shaft 13 of a combined blending and cleaning machine 10, for example, the Rieter Unimix B 7/3 or the Rieter blending opener B 3/3 of the assignee of this application, which is arranged upstream of a microwave oven 11 constructed according to the invention, which is followed by an opening unit 12. This opening unit 12 could be the opening unit of a fine cleaning machine such as, for example, the Rieter ERM cleaning machine.

The fiber flocks present in the outlet chute or shaft 13 of the combined blending and cleaning machine 10, which fiber flocks may be a blend of cotton flocks of different origins or provenances, are formed into a slightly compressed cotton flock web 17 by a guide roll or roller 14 and two take-up or delivery rolls or rollers 15 and 16. This slightly compressed cotton flock web 17 is continuously deposited on a revolving conveyor belt or band 18. The revolving conveyor belt or band 18 is composed of a suitable material, for instance of silicon or polypropylene, which is practically non-absorbent or totally non-absorbent with respect to microwaves. This revolving conveyor belt or band 18 is guided or trained around two deflection rolls or rollers 19 and 21, of which the deflection roll or roller 21 is driven by a suitable drive motor not particularly shown in the drawing. Further deflection rolls or rollers and tension rolls or rollers can also be provided but are not particularly shown in the drawings.

As depicted in FIG. 1, the first deflection roll or roller 19 is already arranged just downstream of the pair of take-up or delivery rolls or rollers 15 and 16 of the combined blending and cleaning machine 10 and is separated from this pair of take-up or delivery rolls or rollers 15 and 16 by means of a guide plate 22 provided for the slightly compressed cotton flock web 17. The driven deflection roll or roller 21 is located directly downstream of the outlet or exit of the microwave oven 11 and upstream of infeed or intake rolls or rollers 23 and 24 of the opening unit 12 which, in the further course or path of the cotton flock web 17, consists of feed rolls or rollers 25 and 26, a cleaning roll or roller 27 and a grating or grid 28. The cotton flock web 17 received from the revolving conveyor belt or band 18 is opened and cleaned by the cleaning roll or roller 27 and the opened or loosened cotton flocks are subsequently fed into a vertically ascending shaft or chute 29 leading to a suitable flock feeder not particularly shown in the drawing.

Figure 2:
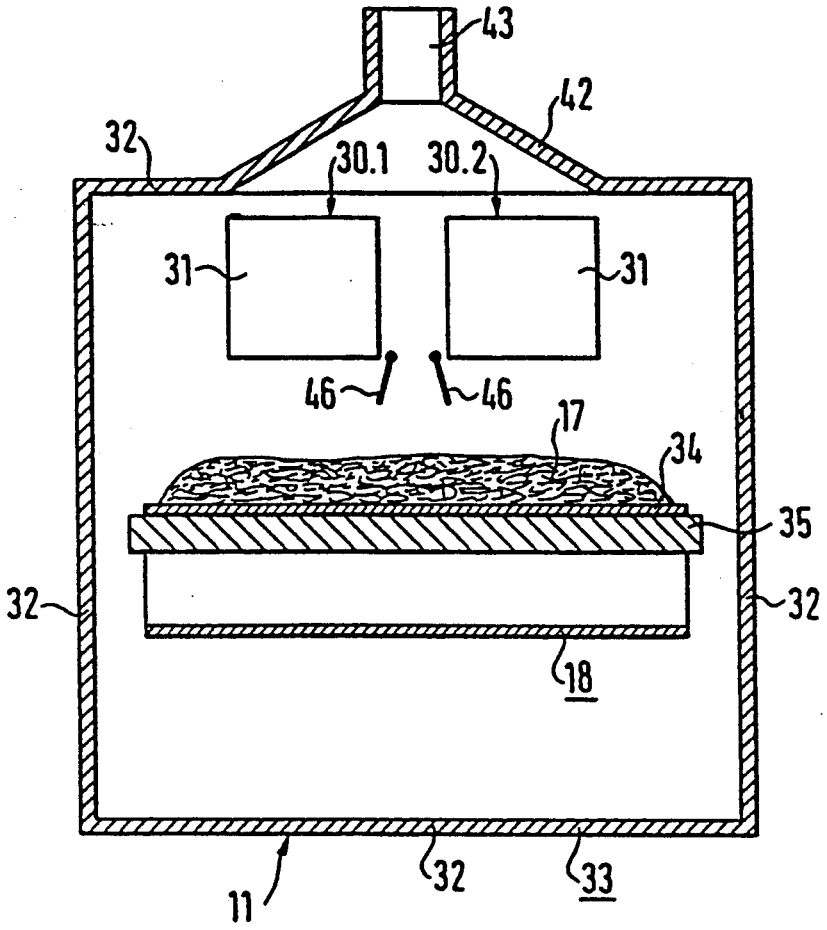
FIG. 2 is a schematic sectional view taken substantially along the lines 2—2 in FIG. 1.

As can be seen also in FIG. 2, the microwave oven 11 consists of two rows 30.1 and 30.2 each containing, for instance, six microwave generators 31. The slightly compressed cotton flock web 17, which is deposited on the conveyor belt or band 18 and has, for instance, a width of 1 meter and a thickness of about 10 cm, lies approximately 15 cm below the bottom or lower ends of the microwave generators 31, so that the microwaves or microwave energy emitted from these microwave generators 31 have the possibility of being uniformly distributed across the width of the slightly compressed cotton flock web 17. This uniform distribution of the microwaves is beneficially influenced by the multiple or repeated reflections at metallic walls 32 of a microwave-oven housing 33 or at a metallic support plate 35 provided beneath the top run or strand 34 of the revolving conveyor belt or band 18.

To prevent radiation deflected by multiple or repeated reflections from escaping through the inlet or the outlet of the microwave oven 11, there are provided screening plates 36 which are mounted at the inlet and outlet sides and which extend from the bottom or lower side of the microwave generators 31 down to just above the surface of the slightly compressed cotton flock web 17. Furthermore, there are present substantially parallel arrangements or arrays of ferrite bars or rods 39 and 41 arranged around a substantially rectangular inlet 37 and a substantially rectangular outlet 38 of the microwave oven 11. Such arrangements or arrays of ferrite bars or rods 39 and 41 absorb any possibly still present microwaves and thus prevent that these microwaves enter the housing of the combined blending and cleaning machine 10 or in this manner reach the opening unit 12. Such radiation is thus kept away from the operational staff.

Above the microwave generators 31 the roof or upper side of the microwave-oven housing 33 is structured as an exhaust or extraction hood 42 and a suitable blower or ventilator not particularly shown in the drawings sucks out or extracts the vapors generated by the microwave heating through a connecting pipe or spigot or stud 43 provided at the top end of the exhaust or extraction hood 42.

Within the microwave-oven housing 33 there are provided various infrared alarm-type sensors or detectors 44, which are connected to a suitable control system 80 equipped with an alarm or signal device 81. In the event of local overheating during operation, the plant and above all the microwave generators 31 are switched off by the control system 80 and a halon extinguishing gas is delivered through nozzles or jets 45 into the microwave-oven housing 33. Oxygen is thus driven out and a fire outbreak is prevented or a developing fire is immediately extinguished.

A power control of the individual microwave generators 31 is possible within certain limits, but the overall power of the plant or installation can be achieved within wide limits by switching on or off individual microwave generators 31.

In this manner, it is possible to readily adapt the heat input or supply to the moisture or humidity content of the cotton and the honeydew contamination.

The microwave devices themselves operate with a wave length of 12 cm at a frequency of 2.45 gigahertz.

The energy supply to the slightly compressed cotton flock web 17 should be dimensioned such that, subject to the speed of passage or travel of the revolving conveyor belt or band 18, the honeydew deposits are heated to about 140° C. This is sufficient to withdraw or extract about 80% of the water contained in such honeydew deposits and convert the latter into a readily processable non-adhesive or no longer tacky condition or state.

Finally, it should be mentioned that it is possible to provide, within the microwave-oven housing 33, controllable deflectors 46 for controlling or directing the microwaves. Such controllable deflectors 46 shown in FIG. 2 are arranged between the adjacent rows 30.1 and 30.2 of the microwave generators 31. These controllable deflectors 46 can be controlled such that a uniform energy distribution across the entire width of the slightly compressed cotton flock web 17 is obtained, without the radiation produced by the two adjacent microwave generators 31 in the middle of the cotton flock web 17 resulting at that location in local overheating of the cotton flock web 17 or of the honeydew deposits. Normally during fabrication of the microwave oven 11, such controllable deflectors 46 are finally adjusted with due regard to the properties of the microwave generators 31 installed in the microwave oven 11.

Figure 3:
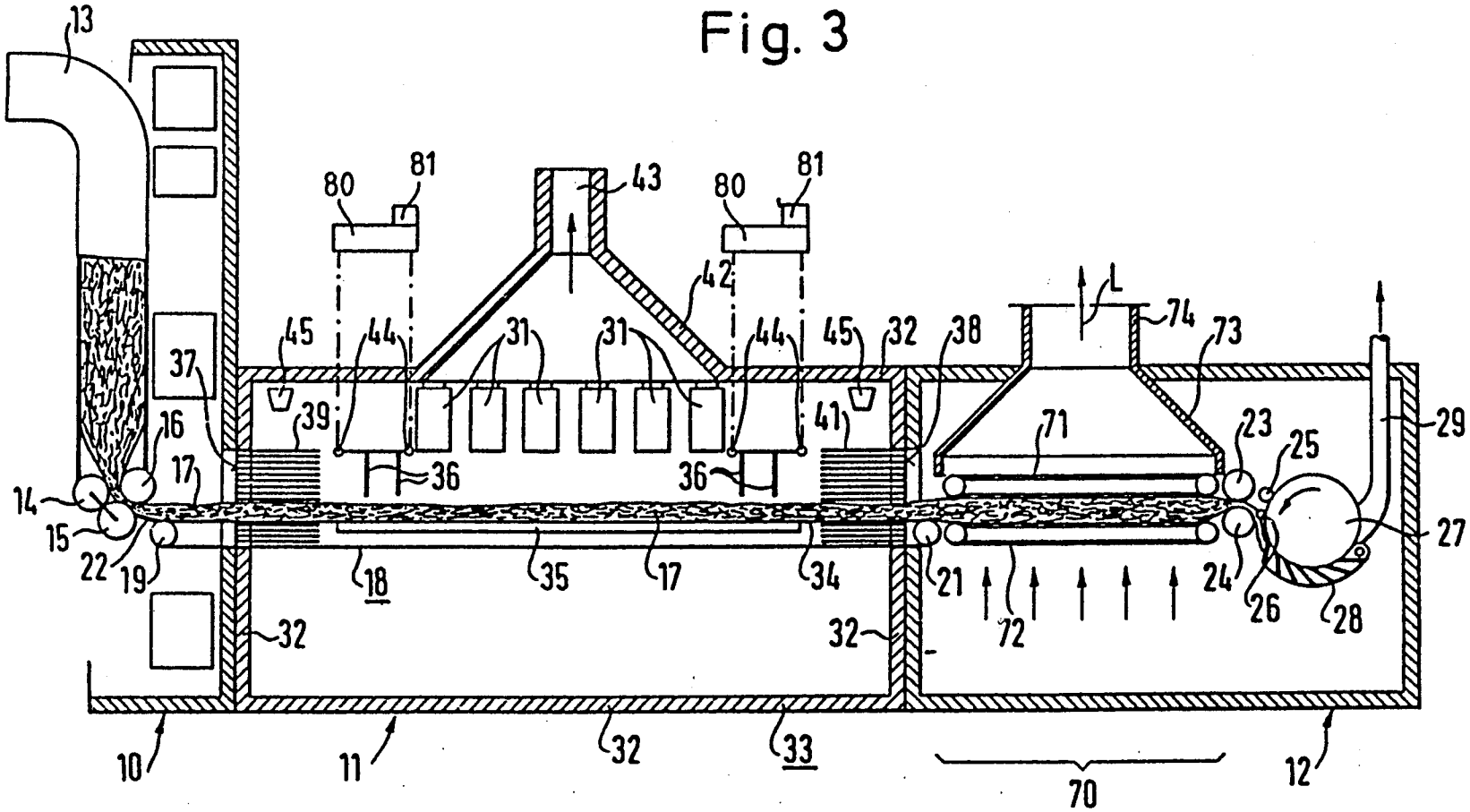
FIG. 3 schematically shows a variant of the plant illustrated in FIG. 1.

FIG. 3 shows a variant of the plant illustrated in FIG. 1 inasmuch as a cooling zone 70 is provided between the deflection roll or roller 21 of the revolving conveyor belt or band 18 and the infeed or intake rolls or rollers 23 and 24. This cooling zone 70 is provided for cooling the heated cotton flock web 17 between two cooling conveyor belts or bands 71 and 72. The cooling zone 70 is covered by an exhaust or extraction hood 73 at which a connecting pipe or spigot or stud 74 is provided. This connecting pipe or spigot 74 is connected to a suitable suction fan (not shown) for generating, for instance, a substantially vertical air current or forced flow L through the cooling conveyor belts or bands 71 and 72.

In the walls which surround or enclose the cooling zone 70 and the opening unit 12 to which the infeed or intake rolls or rollers 23 and 24 belong, there are provided air inlet openings (not shown) to let in the aforesaid air current or forced flow L and the air for the vertically ascending shaft or chute 29.

Depending on the desired or required air moisture or humidity content and the desired or required air temperature of the air current or forced flow L, there can be provided an air conditioning device (now shown) to precede the aforementioned air inlet openings.

The two cooling conveyor belts or bands 71 and 72 are synchronously driven by a suitable single drive which is not particularly shown in the drawing. These cooling conveyor belts or bands 71 and 72 convey the cotton flock web 17 at the outgoing or output speed of the cotton flock web 17 on the revolving conveyor belt or band 18.

As a further variant not particularly shown in the drawings, there is also the possibility of cooling the cotton flock web 17 after or downstream of the opening unit 12. For this purpose, the vertically ascending shaft or chute 29 should have a cross-section and a length which render possible the cooling of the web during its conveyance. In such a case, the velocity of air in the vertically ascending shaft or chute 29 will be slightly above the suspension speed of the cotton flocks, in order to render possible a sufficient or adequate dwell time without an all too excessive height of the vertically ascending shaft or chute 29. There also exists the possibility of air conditioning the air before being drawn into the vertically ascending shaft or chute 29.

While there are shown and described present preferred embodiments of the invention, it is to be distinctly understood that the invention is not limited thereto, but may be otherwise variously embodied and practiced within the scope of the following claims.

Accordingly, what we claim is:

1. An apparatus for treating cotton flocks contaminated with honeydew, by the supply of heat, comprising:

a housing provided with a roof;

a substantially tunnel-shaped microwave oven arranged in said housing and provided with an inlet and an outlet;

a conveyor belt made of material absorbing at most relatively little energy and provided for conveying a compressed web of cotton flocks through said tunnel-shaped microwave oven in a predetermined direction;

two delivery rolls arranged at said inlet of said tunnel-shaped microwave oven for forming the cotton flocks into said compressed cotton flock web and two delivery rolls at said outlet of said tunnel-shaped microwave oven for supplying said web toward an opening unit;

said conveyor belt being guided around two deflection rolls, one at said inlet and one at said outlet of said tunnel-shaped microwave oven; and said roof of said housing of said tunnel-shaped microwave oven being structured as an extraction hood.

2. The apparatus as defined in claim 1, wherein:

said material absorbing at most relatively little energy for said conveyor belt is silicon.

3. The apparatus as defined in claim 1, wherein:

said material absorbing at most relatively little energy for said conveyor belt is polypropylene.

4. The apparatus as defined in claim 1, wherein:

said microwave oven comprises a plurality of microwave generators arranged above said conveyor belt.

5. The apparatus as defined in claim 4, wherein:

said plurality of microwave generators are adapted to be operated at the same time.

6. The apparatus as defined in claim 4, wherein:

said plurality of microwave generators are adapted to be individually operated.

7. The apparatus as defined in claim 4, wherein:

said plurality of microwave generators are arranged substantially in two rows above said conveyor belt.

8. The apparatus as defined in claim 4, wherein:

said plurality of microwave generators constitute ten to fourteen microwave generators.

9. The apparatus as defined in claim 4, wherein:

said plurality of microwave generators constitute twelve microwave generators.

10. An apparatus for treating cotton flocks contaminated with honeydew, by the supply of heat, comprising:

a housing provided with a roof;

a substantially tunnel-shaped microwave oven arranged in said housing and provided with an inlet and an outlet;

a conveyor belt made of material absorbing at most relatively little energy and provided for conveying the cotton flocks through said tunnel-shaped microwave oven;

two deflection rolls arranged one at said inlet and one at said outlet of said tunnel-shaped microwave oven;

one of said two deflection rolls being driveable;

said conveyor belt being guided around said two deflection rolls;

said roof of said housing of said tunnel-shaped microwave oven being structured as an extraction hood; and ferrite bars arranged at said inlet and at said outlet of said tunnel-shaped microwave oven.

11. The apparatus as defined in claim 4, further including:

a cotton flock chute arranged at said inlet of said tunnel-shaped microwave oven and having a bottom end;

said delivery rolls being arranged at said bottom end of said cotton flock chute;

the cotton flock which is fed through said cotton flock chute to said conveyor belt is effected by means of said delivery rolls.

12. The apparatus as defined in claim 11, further including:

that said opening unit forms part of a cleaning machine arranged downstream, with respect to said predetermined direction, of said outlet of said tunnel-shaped microwave oven; and said cotton flock web delivered at said outlet of said tunnel-shaped microwave oven being fed to said opening unit of a cleaning machine.

13. The apparatus as defined in claim 12, further including:

a cotton flock feeder arranged upstream, with respect to said predetermined direction, of at least one carding machine; and said opening unit of a cleaning machine feeding said cotton flock feeder.

14. An apparatus for treating cotton flocks contaminated with honeydew, by the supply of heat, comprising:

a housing provided with a roof;

a substantially tunnel-shaped microwave oven arranged in said housing and provided with an inlet and an outlet;

a conveyor belt made of material absorbing at most relatively little energy and provided for conveying the cotton flocks through said tunnel-shaped microwave oven;

two deflection rolls arranged one at said inlet and one at said outlet of said tunnel-shaped microwave oven;

one of said two deflection rolls being driveable;

said conveyor belt being guided around said two deflection rolls;

said roof of said housing of said tunnel-shaped microwave oven being structured as an extraction hood;

infrared alarm-type sensors arranged within said housing of said tunnel-shaped microwave oven;

a control system;

a halon gas fire-extinguishing installation; and said infrared alarm-type sensors being coupled via said control system with said halon gas fire-extinguishing installation.

15. An apparatus for treating cotton flocks contaminated with honeydew, by the supply of heat, comprising:

a housing provided with a roof;

a substantially tunnel-shaped microwave oven arranged in said housing and provided with an inlet and an outlet;

a conveyor belt made of material absorbing at most relatively little energy and provided for conveying the cotton flocks through said tunnel-shaped microwave oven, said microwave oven comprising a plurality of microwave generators arranged above said conveyor belt;

two deflection rolls arranged one at said inlet and one at said outlet of said tunnel-shaped microwave oven;

one of said two deflection rolls being driveable;

said conveyor belt being guided around said two deflection rolls;

said roof of said housing of said tunnel-shaped microwave oven being structured as an extraction hood;

a cotton flock chute arranged at said inlet of said tunnel-shaped microwave oven and having a bottom end;

delivery rolls arranged at said bottom end of said cotton flock chute;

the cotton flock which is fed through said cotton flock chute to said conveyor belt is effected by means of said delivery rolls;

said delivery rolls forming the cotton flocks into a cotton flock web;

said cotton flock having a predetermined direction of travel;

said plurality of microwave generators forming a tunnel; and screening plates extending transversely with respect to said predetermined direction of travel, ending directly in front of a surface of said cotton flock web, and arranged at said inlet upstream, with respect to said predetermined direction of travel, of said tunnel and at said outlet downstream, with respect to said predetermined direction of travel, of said tunnel.

16. An apparatus for treating cotton flocks contaminated with honeydew, by the supply of heat, comprising:

a housing provided with a roof;

a substantially tunnel-shaped microwave oven arranged in said housing and provided with an inlet and an outlet;

a conveyor belt made of material absorbing at most relatively little energy and provided for conveying the cotton flocks through said tunnel-shaped microwave oven, said microwave oven comprising a plurality of microwave generators arranged substantially in two rows above said conveyor belt;

two deflection rolls arranged one at said inlet and one at said outlet of said tunnel-shaped microwave oven;

one of said two deflection rolls being driveable;

said conveyor belt being guided around said two deflection rolls;

said roof of said housing of said tunnel-shaped microwave oven being structured as an extraction hood;

controllable deflectors arranged between said two rows of said plurality of microwave generators; and said controllable deflectors maintaining substantially uniform the energy density in said cotton flock web.

17. The apparatus as defined in claim 12, further including:

means for cooling provided downstream, with respect to said predetermined direction of travel, of said conveyor belt for cooling said cotton flock web delivered by said tunnel-shaped microwave oven.

18. An apparatus for treating cotton flocks contaminated with honeydew, by the supply of heat, comprising:

a housing provided with a roof;

a substantially tunnel-shaped microwave oven arranged in said housing and provided with an inlet and an outlet;

a conveyor belt made of material absorbing at most relatively little energy and provided for conveying the cotton flocks through said tunnel-shaped microwave oven in a predetermined direction of travel, said microwave oven comprising a plurality of microwave generators arranged above said conveyor belt;

two deflection rolls arranged one at said inlet and one at said outlet of said tunnel-shaped microwave oven;

one of said two deflection rolls being driveable;

said conveyor belt being guided around said two deflection rolls;

said roll of said housing of said tunnel-shaped microwave oven being structured as an extraction hood;

a cotton flock chute arranged at said inlet of said tunnel-shaped microwave oven and having a cotton end;

delivery rolls arranged at said bottom end of said cotton flock chute;

the cotton flock which is fed through said cotton flock chute to said conveyor belt is effected by means of said delivery rolls;

said delivery rolls forming the cotton flocks into a cotton flock web;

an opening unit of a cleaning machine arranged downstream, with respect to said predetermined direction, of said outlet of said tunnel-shaped microwave oven;

said cotton flock web delivered at said outlet of said tunnel-shaped microwave oven being fed to said opening unit of said cleaning machine;

cooling means provided downstream, with respect to said predetermined direction of travel, of said conveyor belt for cooling said cotton flock web delivered by said tunnel-shaped microwave oven;

said cooling means comprising a cooling zone with two superimposed cooling conveyor belts which convey said cotton flock web therebetween; and said two superimposed cooling conveyor belts delivering said cotton flock web to said opening unit of a cleaning machine.

* * * * *